United States Patent [19]

Pearce, Sr.

[11] Patent Number: 4,809,986

[45] Date of Patent: Mar. 7, 1989

[54] REGATTA SIMULATION GAME

[76] Inventor: Lawrence J. Pearce, Sr., 660 E. Main St., Mesa, Ariz. 85205

[21] Appl. No.: 67,372

[22] Filed: Jun. 29, 1987

[51] Int. Cl.[4] ..... A63F 3/00

[52] U.S. Cl. ..... 273/246; 273/284

[58] Field of Search ..... 273/246, 259, 284, 246, 273/259, 284

[56] References Cited

U.S. PATENT DOCUMENTS

| | | | |
|---|---|---|---|
| 1,224,173 | 5/1917 | Kajiyama | 273/249 |
| 1,500,782 | 7/1924 | Vegiard | 273/246 |
| 1,527,219 | 2/1925 | Potter | 273/249 |
| 2,455,519 | 12/1948 | Powers, Jr. | 273/246 |
| 2,977,713 | 4/1961 | Alelyunas | 273/281 |
| 3,656,758 | 4/1972 | Thatcher | 273/246 |
| 3,871,656 | 3/1975 | Selness | 273/259 |
| 4,121,823 | 10/1978 | McBride | 273/249 |
| 4,241,924 | 12/1980 | Arcara | 273/277 |
| 4,550,917 | 11/1985 | Ferris et al. | 273/284 |

FOREIGN PATENT DOCUMENTS

| | | | |
|---|---|---|---|
| 1501739 | 10/1967 | France | 273/246 |
| 8103285 | 11/1981 | PCT Int'l Appl. | 273/246 |
| 567020 | 1/1945 | United Kingdom | 273/246 |
| 889725 | 2/1962 | United Kingdom | 273/246 |

*Primary Examiner*—Richard C. Pinkham
*Assistant Examiner*—Benjamin Layno
*Attorney, Agent, or Firm*—Charles E. Cates; James H. Phillips

[57] ABSTRACT

A regatta board game is disclosed in which a rectangular game board is laid off in a grid of squares established by a first series of parallel lines extending in a first direction and a second series of parallel lines extending in a second direction which is normal to the first direction. Some of the squares are designated as falling within a first, second or third category, the first category designating preliminary course marker positions, the second and third categories providing an indication that a player is to draw a card which partially determines the progress of play. A single eight-sided die is provided, and a plurality of players' tokens and a plurality of course marking pennants are also included among the game accessories, the pennants being each adapted to mark a selected one of the squares in the first category as a sequential position in a randomly selectable course set forth on a "Course Card" drawn just prior to the commencement of play. When a player's token lands on a square in the second or third category, a "Wind Card" or a "Boat Card" is drawn, each card carrying indicia specifying that a wind or boat/crew-related event has taken place and what the consequence of that event is to the competitor. A fourth series of cards, designated as "Tacking Cards", are earned upon the roll of a certain count of the die and may be reserved for later tacking use during maneuvering of the player's token.

3 Claims, 3 Drawing Sheets

REGATTA SIMULATION GAME

FIELD OF THE INVENTION

This invention relates to the board game art and, more particularly, to a board game in which Americas' Cup racing is closely simulated.

BACKGROUND OF THE INVENTION

The recent recapture by the United States of the America's Cup from Australia has increased the general awareness of the sport of sailboat racing which is known in the art as a regatta. However, the elaborate character of a regatta is such that only a very few persons ever have the authentic experience of participating in such an event. As a result, there is a place for a game which accurately simulates much of the actual experience of participating in a regatta.

In the past, there have been board games and the like proposed which generally incorporated simulated aspects of sailing. For example, such games are disclosed in U.S. Pat. Nos. 1,500,782 to Vegiard; 2,455,519 to Powers, Jr.; 3,656,758 to Thatcher; and 3,871,656 to Selness 4,550,917 to Ferris et al., and foreign patents (U.K.) Nos. 889,725 to Benyon and 567,020 to Barton; (France) No. 1,501,739 to Jaillard; and (PCT) No. 8,103,285 to Selness. While each of these prior art references disclose, meritorious aspects of a sailing game, each suffers from one or more drawbacks which include: the use of predetermined courses which offer no variation in play except for the random selection made by movement of a spinner; the concentration on the learning of specific skills relating to the sails on a boat with little regard to strategy or the reasoning requirements to overcome the progress of opponents; the primary emphasis on skills affording little or no variation in play; and allowing for no exercise in the reasoning necessary to adapt to various situations and/or to overcome an opponent's progress. More briefly stated, the prior art regatta board games do not effectively actually simulate the numerous variables of regatta racing which present widely diverse situations to which a competitor must respond.

OBJECTS OF THE INVENTION

It is therefore a broad object of my invention to provide an improved regatta simulation board game.

It is another object of my invention to provide such a regatta simulation board game presenting many variable situations to a competitor which he must deal with in a manner closely reminiscent of actual regatta conditions.

It is yet another object of my invention to provide such a regatta simulation board game which incorporates skill, reasoning and random chance in such a manner that the competitors, whether they win or lose, enjoy playing the game.

In a more specific aspect, it is an object of my invention to provide a board game which provides wholesome entertainment and amusement while encouraging competitors to think quickly, using both logic and reason, to circumnavigate a randomly selected regatta course over a special game board through the use of a special die and indicia presented on cards.

SUMMARY OF THE INVENTION

Briefly, these and other objects of my invention are achieved by providing a rectangular game board which is laid off in a grid of squares established by a first series of parallel lines extending in a first direction and a second series of parallel lines extending in a second direction which is normal to the first direction, the number of lines in the second series being more than that in the first series to obtain a rectangular game board playing area. Some of the squares in the grid are designated as falling within a first, second or third category, the first category designating preliminary course marker positions, and the second and third categories (which are preferably indicated by color coding) providing indications that a player is to draw a color coded card which partially determines the progress of play. A single eight-sided die is provided with each side carrying a unique one of the numbers 1–8. A plurality of player's tokens and a plurality of course marking pennants are also included among the game accessories, the pennants being each adapted to mark a selected one of the squares in the first category as a sequential position in a randomly selectable course set forth on a "Course Card" drawn just prior to the commencement of play. When a player's token lands on a square in the second category, a "Wind Card" (which carries indicia specifying that a wind-related event has taken place and what the consequence of that wind-related event is to the competitor) is drawn. Similarly, when a competitor's token lands on a square in the third category, a "Boat Card" is drawn, each card in the Boat Card series carrying indicia specifying that a boat/crewrelated event has taken place and what the consequence of that boat/crew-related event is to the competitor. The cards in the fourth series are designated as "Tacking Cards", and a Tacking Card is earned upon the roll of a certain count of the die and may be reserved for later tacking use during maneuvering of the player's token. Specific rules of play are related to the game paraphernalia to closely simulate the skill, reasoning, and random chance which take place during an actual regatta.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

Figure 3:
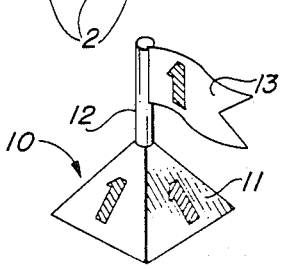
Figure 4:
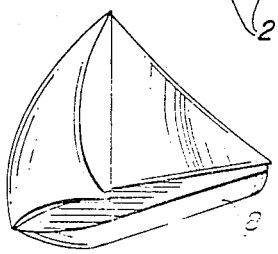
Figure 6:
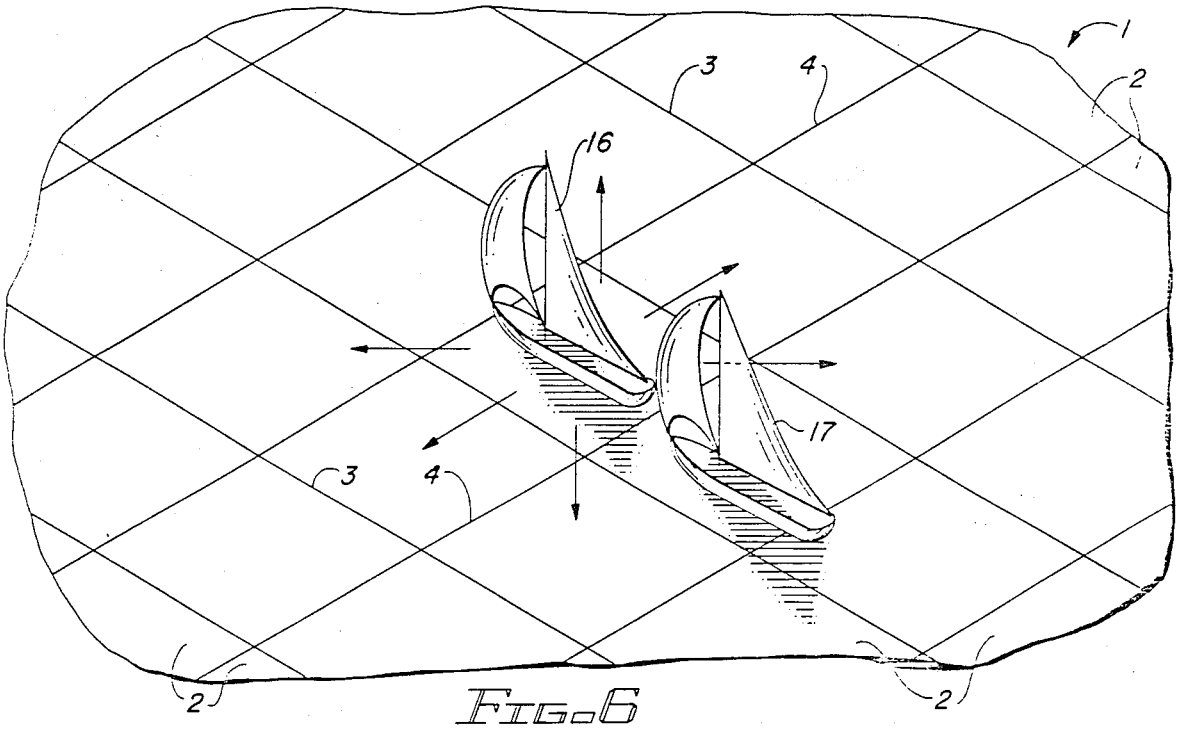
Figure 7:
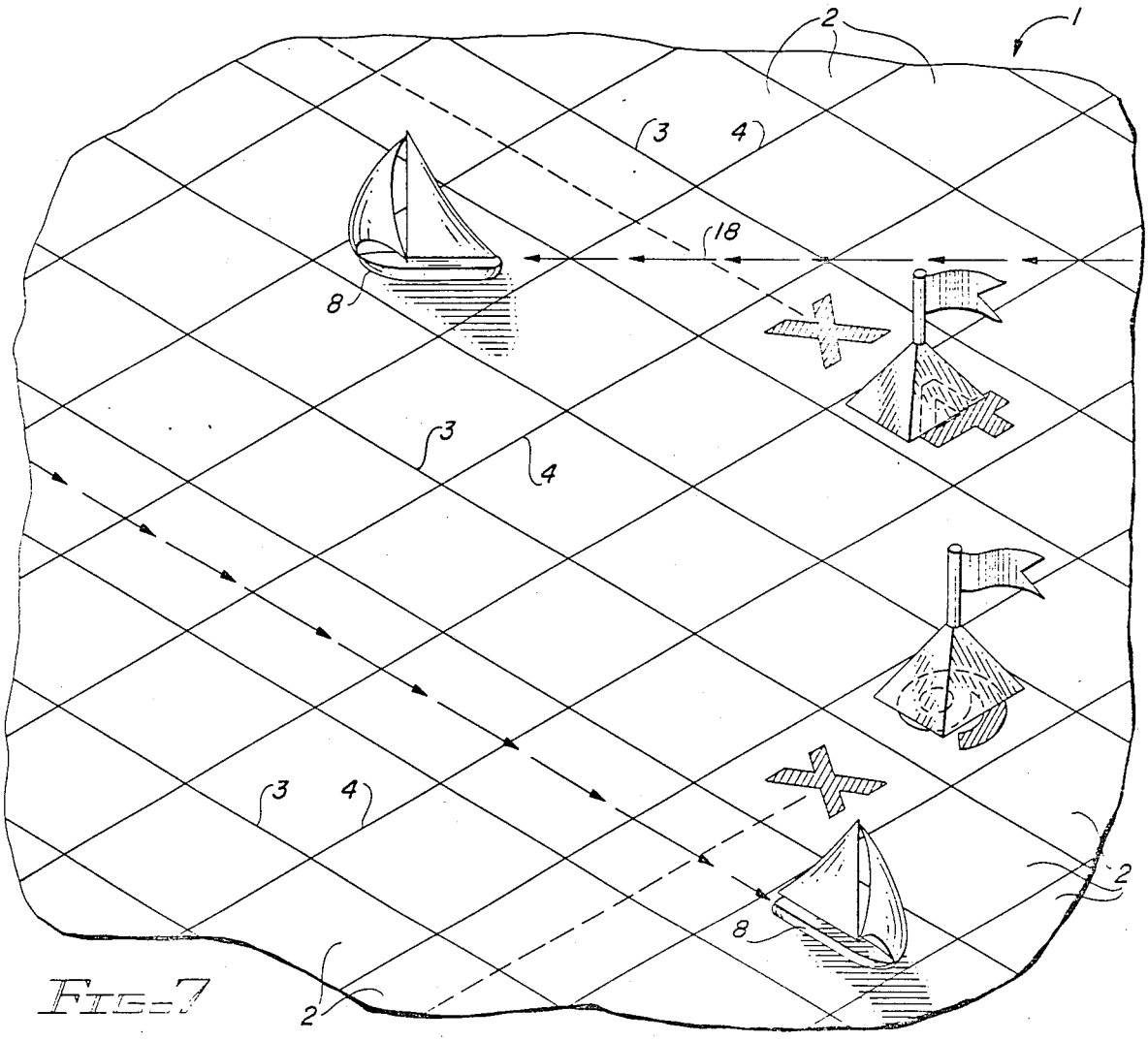

FIGS. *2a–2d*, respectively, illustrate exemplary Course Cards, Tacking Cards, Wind Cards and Boat Cards which are employed during the progress of the game;

FIG. 3 illustrates a presently preferred configuration for a pennant, a plurality of which provide an indication of the boundaries of the current course;

FIG. 4 illustrates one popular configuration for a player's token;

FIG. *5a–5c* illustrate, respectively, side, top and bottom views of a specially configured eight-sided die the roll of which partially controls the progress of a regatta simulation;

FIG. 6 illustrates certain exemplary moves which may be taken during the progress of a game in which a player's token lands on a square currently occupied by an opponent; and FIG. 7 illustrates certain activity which a player's token may encounter in the region of a "mark".

DETAILED DESCRIPTION OF THE INVENTION

Game Apparatus

Figure 1:
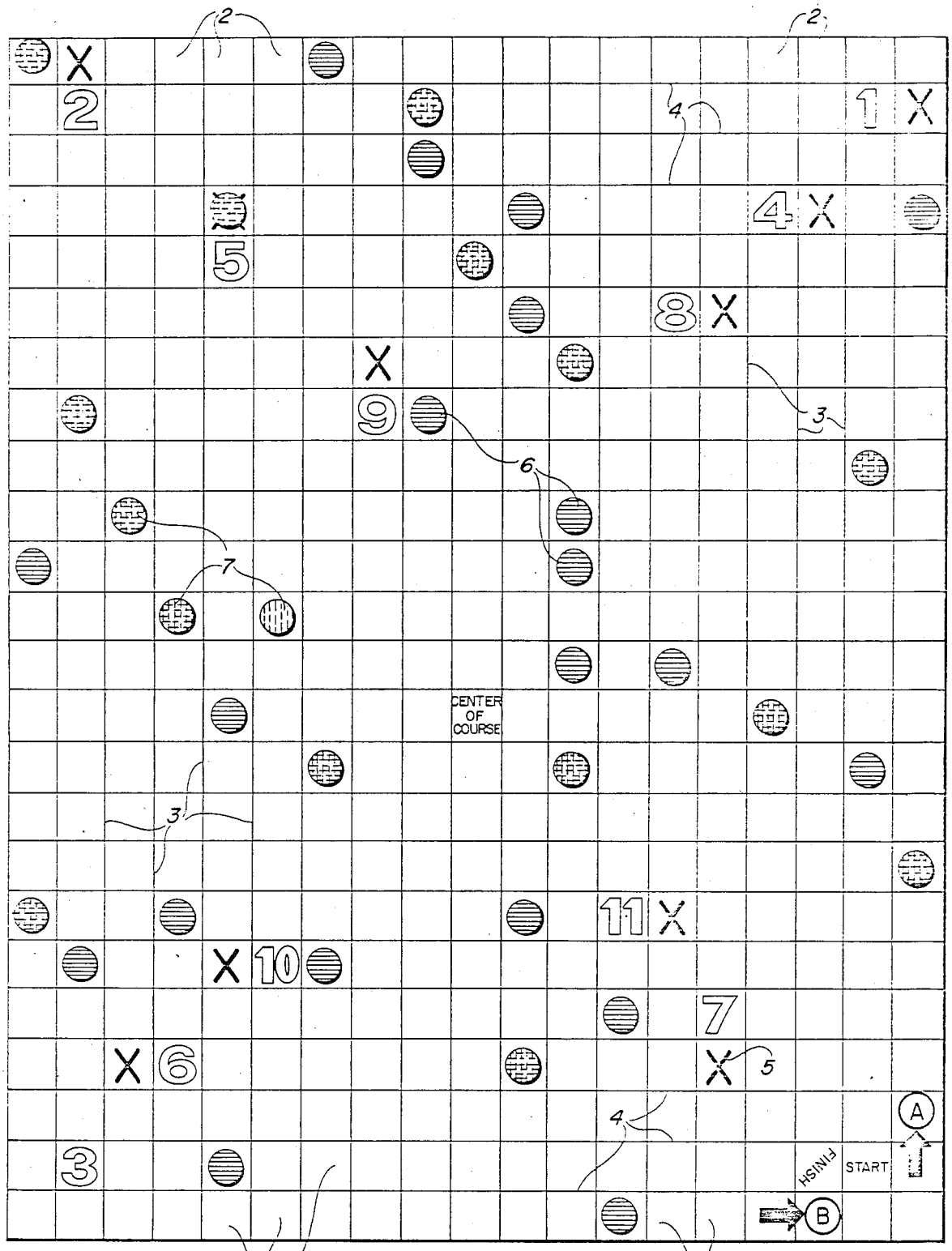
FIG. 1 is a plan view of a game board prepared in accordance with the subject invention.

Referring now to FIG. 1, there is shown a game board 1 on which the subject regatta simulation game is played. The game board 1 is laid off in a grid of squares 2 established by a first series of parallel lines 3 extending in a first direction and a second series of parallel lines 4 extending in a second direction which is normal to the first direction. The number of lines 4 in the second series is more than the number of lines 3 in the first series such that a rectangular game board playing area is obtained. Preferably, the squares are on the order of one inch wide and one inch long, and the gameboard 1 may consist of a rectangular group of nineteen row squares and twenty-four column squares; however, other dimensions and proportions are contemplated.

A few of the squares 2 fall into first, second and third special categories. The squares in the first category are indicated by the presence of an "X" and by an adjacent bold face number such as, merely by way of example, the "X" appearing in the specific square identified by reference character 5 adjacent the bold numerical figure "7". It will be observed that there are a total of eleven such squares in this first category and that they are concentrated in the corners of the game board 1.

Several more or less randomly distributed squares are designated as falling within the second category by color coding such as by emplacing a blue dot in the square center. Exemplary squares falling within the second category are indicated by the reference character 6. Similarly, squares falling within the third category are indicated by, for example, the emplacement of yellow dots in the square center, and representative squares so designated as falling within the third category are identified by the reference character 7.

Figure 2A:
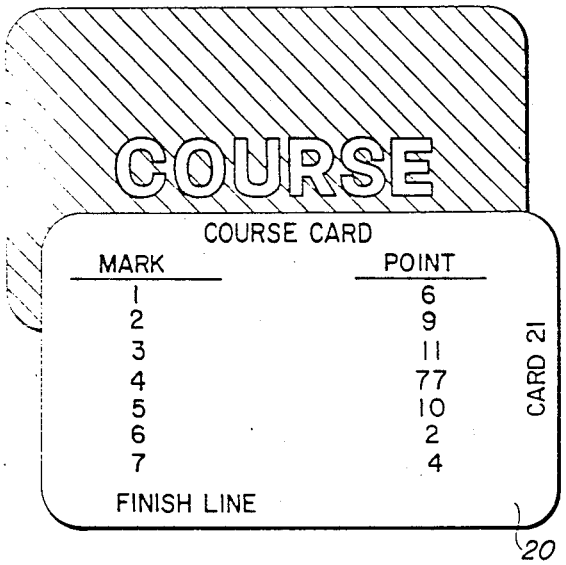
Figure 2B:
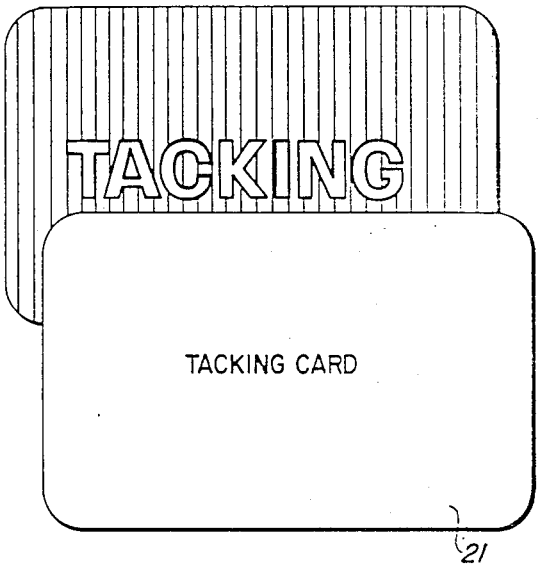

As will become more apparent from the discussion below under the Rules of Play heading, four different series of cards are employed in playing the subject regatta simulation game. The cards 20 in the first series, as shown in FIG. 2*a* are designated as Course Cards, and each card in the first series carries indicia specifying the designation of individual squares in the first category (as discussed above) as successive course marker positions. Each card 21 in the fourth series, FIG. 2*b*, carries an indication that it is a Tacking Card; i.e., a card that reserves the right of a player to tack at a time he selects if he is in possession of such a Tacking Card.

Figure 2C:
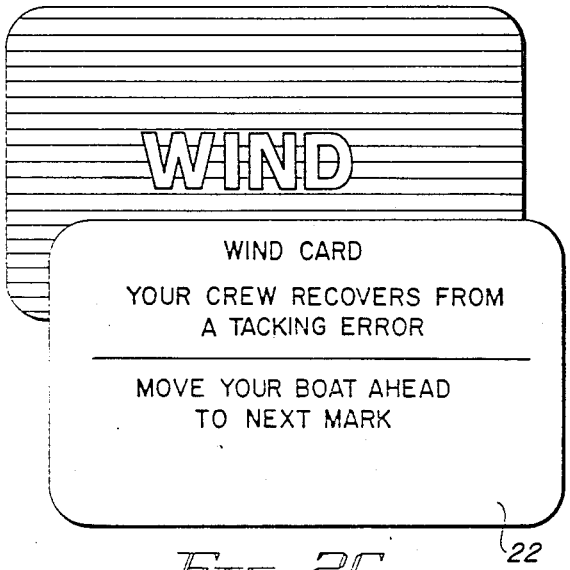
Figure 2D:
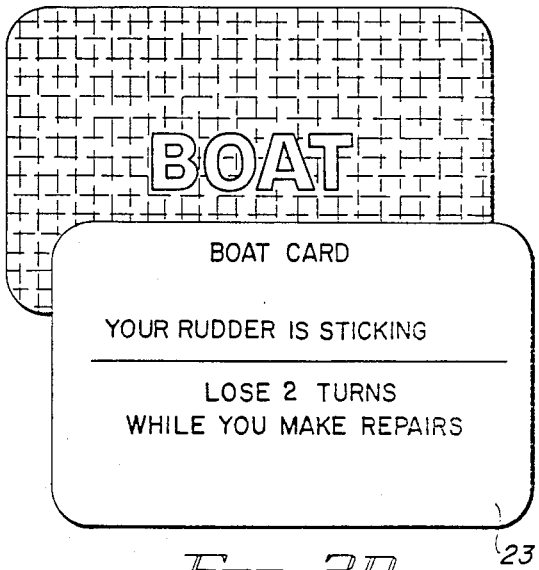

The cards in the second series, illustrated in FIG. 2*c*, are designated as Wind Cards, and each card 22 in the second series carries indicia specifying that a wind-related event has taken place and what the consequence of that wind-related event is to the player who has drawn the card. Similarly, the cards in the third series, illustrated in FIG. 2*d*, are designated as Boat Cards, and each Boat Card 23 carries indicia specifying that a boat/crew-related event has taken place and what the consequence of that boat/crew-related event is to the player.

It will be understood that there are a plurality of cards in each series. For example, another exemplary Course Card 20 might read:

| COURSE CARD | |
|---|---|
| MARK | POINT |
| 1 | 2 |
| 2 | 10 |
| 3 | 7 |
| 4 | 5 |
| 5 | 6 |
| 6 | 11 |
| 7 | 1 |

In point of fact, a number of Course Cards on the order of twenty-four is contemplated to insure a diversity of courses over a series of simulated regattas, and the combinations possible are far in excess of that number.

Another exemplary Wind Card 22 might read

You've misjudged the wind; Move your boat back five spaces and tack to port one square.

And yet another might read:

The wind has freshened; Move ahead five spaces.

Again, a substantial number of differing Wind Cards are contemplated and would be included in the game set. Finally, another exemplary Boat Card 23 might read:

Your main sail zipper is stuck and your mastman is having trouble making repairs; lose one turn.

An appropriate number of Boat Cards is also supplied.

While the players' tokens may take any form of appropriate dimensions, it is preferred, as shown in FIG. 4, that they be in the form of small boats 8 of differing colors to identify the token of a given player. The length dimension should not exceed the width of a single square 2 on the board 1. Thus, in accordance with the representative dimensions given above for the board 1, the boat tokens 8 should be limited to a length of about one inch and appropriate width and height dimensions which may be on the order of one-fourth inch and one inch, respectively.

As shown in FIG. 3, a set of pennant assemblies 10 is provided among the game accessories, and each pennant in the set carries one of the numerals 1–n where n is the number of actual marker positions to be employed during a regatta simulation session. Typically, seven pennants carrying the numbers 1–7 are employed. Each pennant assembly 10 includes a four-sided pyramidal base portion 11 boldly carrying the number for that pennant assembly on each of the four pyramid sides. The base dimensions of the pyramid may be on the order of three-fourths inch by three-fourths inch to nicely fit within one of the squares of the game board 1 falling within the first category. A mast 12 extending upwardly from the apex of the pyramid supports a pennant 13 which also carries the number of that given pennant assembly.

Figure 5A:
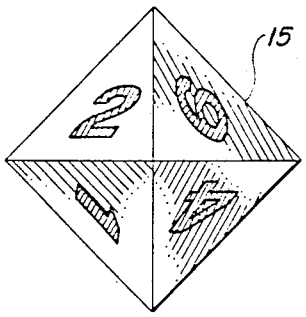
Figure 5B:
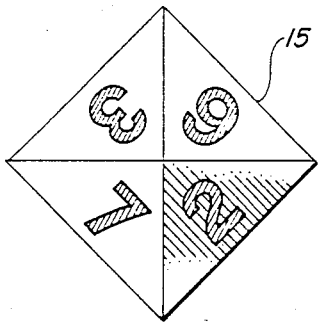
Figure 5C:
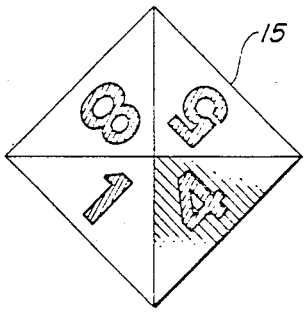

As shown in FIGS. 5*a*, 5*b* and 5*c*, an eight-sided die 15 is employed during game play, and each side of the die carries a unique one of the numbers 1–8. The eight-sided die 15 is configured with four sides situated on each die-half disposed in a pyramid configuration. Thus, as best shown in the bottom view of FIG. 5*c*, the four pyramid sides in view carry the respective numbers "1", "4", "5" and "8", and the opposing top side, FIG. 5*b*, carries the numbers "2", "3", "6" and "7". Thus, it will be appreciated that when the die 15 is thrown, it will come to rest on a triangular pyramid side, and the actual value of the throw will be the opposite triangular side which is horizontal to the plane of throw.

Rules of Play

To initiate play, the playing board illustrated in FIG. 1 is placed on a flat surface. Each player (typically, there are 2–8 competitors) selects a token which, as previously noted, is preferably a small boat. One player then randomly selects one of the twenty-four available Course Cards as depicted in FIG. *2a*. The pennant assemblies 10 (as shown in FIG. 3), which are numbered one through seven, are then placed around the course in accordance with the indicia on the selected Course Card to define the course for the upcoming regatta. By way of example, if the Course Card lists the first mark as 5, then pennant assembly number one is placed over the square identified by the "X" adjacent the numeral 5 on the playing board. If the second mark listed on the selected course card is 6, then pennant assembly number two in its holder is placed over the numeral 6 on the playing surface. Once all seven pennants are placed upon the board, then competitive play may begin. The players decide who should roll the eight-sided die (FIG. 5) first, and the die is then rolled by that player. Each player rolls the die once for his turn unless instructed to do otherwise by the cards in play.

To begin movement of a boat (token), a player must first roll a one or a six. If a player rolls a one or a six, his boat is placed at the starting position marked "A" on FIG. 1. Once a player has reached the starting position, each successive roll of the die by him indicates how many squares he may move his boat. The player then moves his boat around the board according to the pattern formed by the distribution of the pennant assemblies; i.e., around the course determined for the immediate regatta. All boats pass to the right of each mark (and thus move in a counterclockwise direction) along a path formed by the squares on the board. Movement is in a straight line until a player rolls a one on the die. After the start, a player who rolls a one on the die may turn or "tack" his boat in another direction. Should the player decide to tack later, the player is afforded the opportunity to take a Tacking Card and later turn his boat at another point on the course in exchange for surrendering the Tacking Card. If the player rolling the one desires to tack at the time of the roll, the boat is moved one square in the new direction of travel. A player may travel horizontally, vertically or diagonally across the board, but may not turn or change directions without rolling a one on the die or surrendering a previously obtained Tacking Card. If a player reaches the end of a particular row or column of squares, he may not turn until he has first rolled a one or presented a tacking card to do so.

As each player's boat traverses the course, it will, from time to time, land on the second category squares marked with a blue dot (which signifies that a Wind Card is to be drawn) or on a third category square identified by a yellow dot which signifies that a Boat Card is to be drawn, each from the appropriate stack. The player then moves his boat according to the indicia (instructions) printed on the card drawn. After the card is used, it is returned to the appropriate stack face up so that, when all the cards in a particular stack have been used, they may be reshuffled. (All cards are shuffled before starting a game, and they may not be used from game to game without reshuffling.)

A player proceeds in turn around each mark until, after he has passed the seventh mark, the player heads for the finish line. The finish line can only be crossed in the line indicated by the finish arrow and only by a boat traveling in the same direction as the finish arrow shown as "B" in FIG. 1. The first player to cross the finish line is the winner.

During play, a player whose boat lands on an opponent's square causes that opponent's boat to "tack" away from his current course in the direction chosen by the "skipper" of the boat which is forced to tack; however, the boat that is forced to tack may not continue on its current course, but must turn as shown in FIG. 6. Thus, boat 16, which is being forced to tack, must change directions to the right (starboard) or left (port) or diagonally as shown by the several arrows when forced to tack by the fact that the boat 17 has landed on the same square. After the completion of the turn of boat 17, however, if boat 16 has a Tacking Card in his possession or rolls a one, he may exchange places with boat 17, thereby forcing boat 17 to tack in the same manner as boat 16 was forced to tack by boat 17 during the play of boat 17.

A boat or token is considered to have crossed a "mark" when the boat passes the line (e.g., 18) formed by the "X" square and the center of the immediately adjacent numbered square which is the "mark", the general area identified by a sequential pennant assembly as previously described. If a boat passes that line anywhere on the right hand side (starboard side) of the mark, then he has correctly passed the mark. When a Boat Card or Wind Card directs a player to move forward or back to a given mark, then the affected boat is placed on the "X" square next to the mark, and the direction of travel is away from the mark. To change direction when moving off the "X" square, a player is required to roll a one or present a Tacking card. In routine play, no player may "hit" the mark which is to say that the square in which the mark lies cannot be passed nor occupied by any player's boat. If a player is traveling in line with a mark, he must travel up to the mark and wait for a one or use a Tacking Card to turn away from the mark. A player may not go directly over the mark; thus, if his boat is two squares from a mark and the rolled die shows five, the player may only move up to the mark and then wait for his next turn to roll a one or use a Tacking Card to turn.

Those cards drawn that instruct a player to change places with an opponent will also indicate that this is done at the option of the player that draws the card. However, when a change is made and either player lands on a square marked with a colored dot, that player must draw a card from the stack indicated by the color of the dot.

For convenience, the various cards 20, 21, 22, 23 are color coded. The Tacking Cards 21 are salmon colored and marked with the words "Tacking Card". The Course Cards 20 are green, the Boat Cards 22 are yellow and the Wind Cards 23 are blue; and each is identified by words as well as a distinctive color.

In a presently preferred embodiment, the playing board is twenty-four inches by eighteen inches with squares which are approximately one inch by one inch such that, along the "vertical" dimension of the board there are twenty-four squares, and along the "horizontal" dimension of the board there are eighteen squares. (These dimensions and distribution of squares are not critical although a generally rectangular game board surface is desirable.) These squares are placed such that some parts of various courses that are shown on the Course Cards appear to overlap from one mark to another, thereby providing a more challenging course by forcing players to tack their boats at inopportune moments during the game. The positions of numerals and dots are statistically determined such that any of the twenty-four Course Cards selected will almost certainly present all players during a given regatta simulation with squares requiring selection of Wind and/or Boat Cards during their progress over the course.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A regatta simulation game comprising:

(A) a rectangular game board, said game board being laid off in a grid of squares established by a first series of parallel lines extending in a first direction and a second series of parallel lines extending in a second direction which is normal to said first direction, the number of lines in said second series being more than the number of lines in said first series to obtain a rectangular game board playing area;

(B) means visually designating a first plurality of said squares as falling within a first category;

(C) means visually designating a second plurality of said squares as falling within a second category;

(D) means visually designating a third plurality of said squares as falling within a third category;

(E) an eight-sided die, each side thereof carrying a unique one of the numbers 1–8;

(F) a plurality of players' tokens;

(G) a plurality of course marking pennants each adapted to mark a selected one of said squares in said first category as a sequential position in a randomly selectable course laid out on said grid prior to commencement of competitive play during a game session, each of said course marking pennants carrying a unique one of the numbers 1-n where n is the number of course markers used during a given game session; and (H) first, second, third and fourth series of cards;

1. said first series of cards being designated as Course Cards, each card in said first series carrying indicia specifying the designation of individual squares in said first category as course marker positions;
2. said second series of cards being designated as Wind Cards, each card in said second series carrying indicia specifying that a wind-related event has taken place and the consequence of that wind-related event to the competitor;
3. said third series of cards being designated as Boat Cards, each card in said third series carrying indicia specifying that a boat/crew related event has taken place and the consequence of that boat/crew-related event to the competitor; and 4. said fourth series of cards being designated as Tacking Cards, each card in said fourth series carrying only an indication that it is a Tacking Card.

2. The regatta simulation game of claim 1 in which a card from said second series is randomly selected in response to a player's token landing on a square in said second category and in which a card from said third series is randomly selected in response to a player's token landing on a square in said third category.

3. The regatta simulation game of claim 2 in which n equals seven.

* * * * *